US005321385A

United States Patent [19]

Rilling

[11] Patent Number: 5,321,385

[45] Date of Patent: Jun. 14, 1994

[54] WIPER FOR AN ELECTRIC ROTARY POTENTIOMETER

[75] Inventor: Heinz Rilling, Eberdingen, Fed. Rep. of Germany

[73] Assignee: Robert Bosch GmbH, Stuttgart, Fed. Rep. of Germany

[21] Appl. No.: 880,395

[22] Filed: May 8, 1992

[30] Foreign Application Priority Data

May 8, 1991 [DE] Fed. Rep. of Germany ..... 4115011

[51] Int. Cl.[5] ..... H01C 1/12

[52] U.S. Cl. ..... 338/202; 338/162; 338/167; 338/171; 338/136; 338/137

[58] Field of Search ..... 338/171, 174, 202, 167, 338/136, 118, 125, 152, 98, 137, 162; 200/272, 274, 282, 283, 284, 257, 275; 174/50, 52, 261; 411/518, 519, 525; D13/173

[56] References Cited

U.S. PATENT DOCUMENTS 2,866,054 12/1958 Purdy ..... 338/174
4,188,606 2/1980 Bomar et al. ..... 338/137
4,845,461 7/1989 Hochholzer ..... 338/202
4,884,052 11/1989 Eitoku et al. ..... 338/202

FOREIGN PATENT DOCUMENTS 2777262 9/1977 Fed. Rep. of Germany .

*Primary Examiner*—Marvin M. Lateef
*Attorney, Agent, or Firm*—Edwin E. Greigg; Ronald E. Greigg

[57] ABSTRACT

A wiper for an electric rotary potentiometer, in particular for use as a rotary position transducer, having a contact spring for pickup on a resistor track, and a rotatable spring holder on which the contact spring is secured nonrotatably. To save time and expense in assembling the contact spring and the spring holder, at least one fastening tang with a detent head protrudes at approximately right angles from the spring holder, and the contact spring has circular-annular-segmental detent straps, disposed on a circle, which lock into place behind the detent head under spring tension.

12 Claims, 2 Drawing Sheets

WIPER FOR AN ELECTRIC ROTARY POTENTIOMETER

BACKGROUND OF THE INVENTION

The invention is based on a wiper for an electric rotary potentiometer, particularly for use as a rotary position transducer.

In a known wiper of this type (German Patent 21 11 262), the contact spring is secured to the spring holder by riveting. Riveting is labor-intensive and is a substantial factor in the production cost.

OBJECT AND SUMMARY OF THE INVENTION

The wiper according to the invention has the advantage that the contact spring is installed in a time-saving manner yet is retained as reliably as before, so that a reduction in manufacturing costs is attainable. In the fastening of the invention, the outwardly bent inner contours of the circular-segmental detent straps form at least one resilient fastening ring integrated with the contact spring; the ring locks into place by force and form-fittingly on the detent body of the fastening tang and presses the contact spring against the bottom of the receiving indentation with a certain contact pressure. When it is installed, the contact spring is simply clipped by its receiving region onto the spring holder, and the elastically spreading integrated fastening ring slides over the detent head of the fastening tang and snaps into place behind it. It will be appreciated that this makes the installation process simple, time-saving, and lower in cost.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
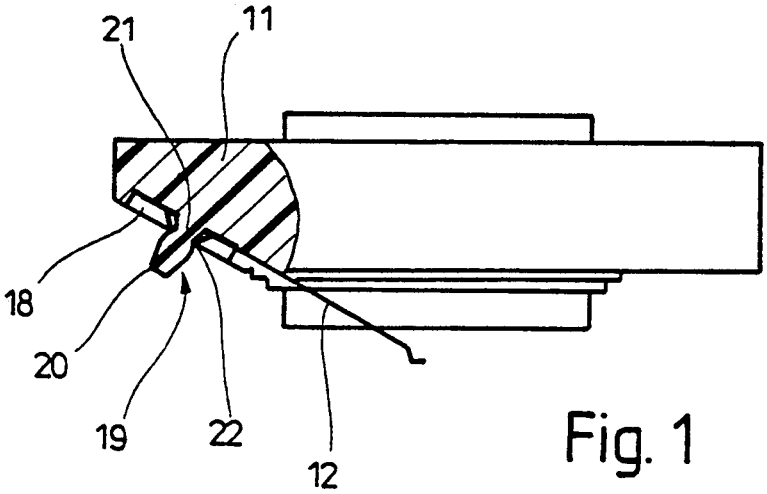
FIG. 1 is a side view of a wiper for an electric rotary potentiometer, shown partly cut away.
Figure 2:
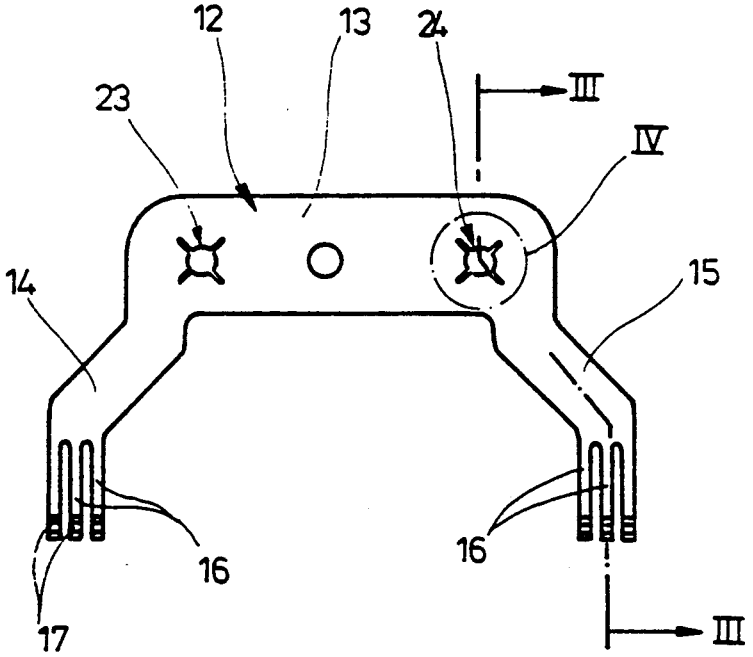
FIG. 2 is a plan view of a contact spring of the wiper of FIG. 1.
Figure 3:
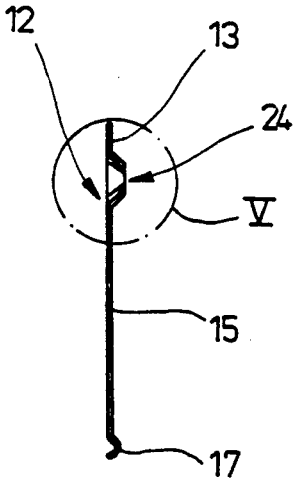
FIG. 3 is a section through the contact spring taken along the line III—III of FIG. 2.

The wiper shown in FIG. 1 forms the rotary part of an electric rotary potentiometer, which is used as a rotary position transducer, for instance for sensing the rotary position of a throttle valve in the intake pipe of an internal combustion engine. The wiper comprises a spring holder 11, which is secured on a shaft, in this example on the throttle valve shaft, in a manner fixed against relative rotation, and a contact spring 12 fastened to the spring holder 11. As can be seen from FIGS. 2 and 3, the contact spring 12 has a transverse rib 13, with two arms 14, 15 pointing integrally away from it; three parallel contact prongs 16 are cut out of the free ends of each arm. Convex contact faces 17 are pressed out of the end region of each contact prong 16; with them, the contact prongs 16 rest in a known manner on respectively associated resistor planes and pick up variably great resistances depending on the rotary position of the wiper.

Figure 4:
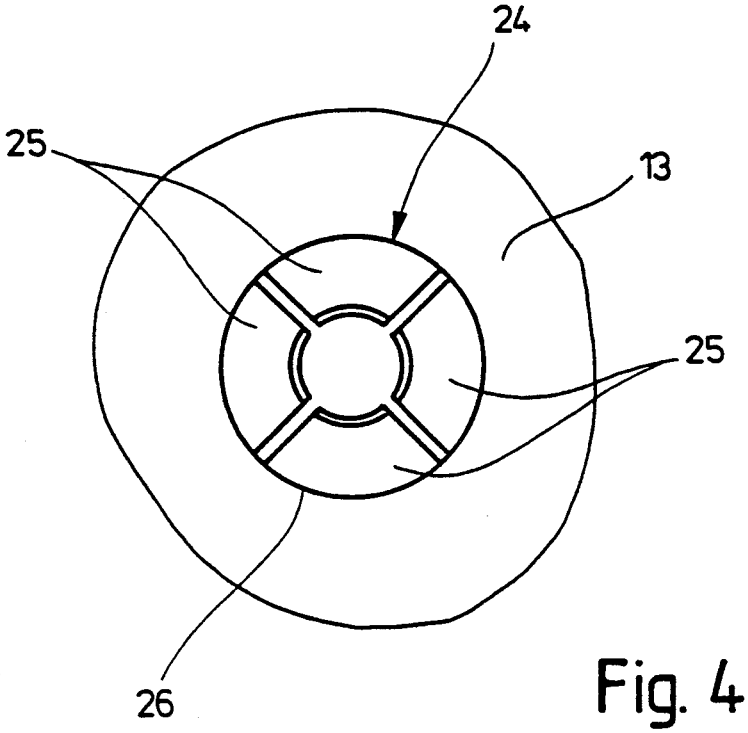
FIG. 4 is an enlarged view of the detail IV of FIG. 2.
Figure 5:
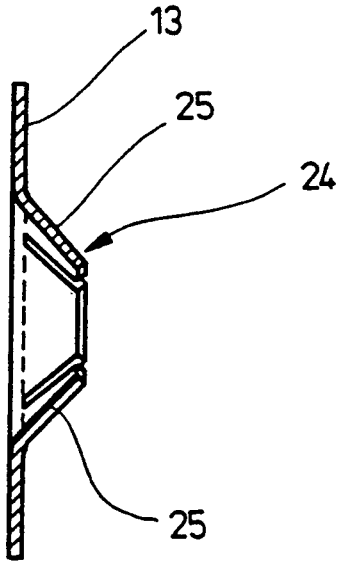
FIG. 5 is an enlarged view of the detail V of FIG. 3.

For fastening the contact spring 12 to the spring holder 11, a receiving indentation 18 is provided in the spring holder; the transverse rib 13 of the contact spring 12 can be placed substantially form-fittingly in this indentation. Two spaced-apart fastening tangs 19 protrude at approximately right angles from the bottom of the receiving indentation 18. Each fastening tang 19 has a conical detect head 20 that tapers toward its end. A detent groove 22 is provided as the transition from the detent head 20 to the neck 21. Two resilient fastening rings 23, 24 are integrated with the transverse rib 13 of the contact spring 12; they are disposed at the same spacing from one another as the fastening tangs 19 on the spring holder 11. Each fastening ring 23, 24 is formed by four circular-annular-segmental detent straps 25, which are disposed on a circle and each extend over a circumferential angle of 90°. The detent straps 25 are cut free from the material of the contact spring 12 and are bent out of the plane of the spring and deployed obliquely (see FIGS. 4 and 5) around the outline 26 located on the circle having the largest diameter. The deployment is done in such a way that the inside diameter cleared by the detent straps 25 is slightly greater than the diameter of the circle on which the bottom of the annular detent groove 22 rests on the fastening tang 19.

To install the contact spring 12 on the spring holder 11, the contact spring 12 is placed on the spring holder 11 in such a way that both of its fastening rings 23, 24 slide onto the detent heads of the fastening tangs 19. Then the contact spring 12 is pressed toward the receiving indentation 18 in the spring holder 11, by exerting pressure upon the transverse rib 13; as a result, the detent straps 25 of the fastening rings 23 24 spread apart and slide past the two detent heads 20. At the end of the displacement motion, the transverse rib 13 of the contact spring 12 rests essentially form-fittingly in the detent indentation 18, and the detent straps 25 of the fastening rings 23, 24 engage the detent groove 22 behind the detent heads 20 in a form-fitting and force-locking manner, in the course of which they exert an axial compression force upon the transverse rib 13 that presses the rib against the bottom of the receiving indentation 18. The contact spring 12 is thus retained reliably securely and unremovably on the spring holder 11. Removal of the contact spring 12 can be done only by bending open the detent straps 25, which as a rule leads to destruction of the contact spring 12.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A wiper for an electric rotary potentiometer, particularly for use as a rotary position transducer, having a contact spring that has at least one contact prong for establishing electrical contact for a circular resistor path, and having a rotatable spring holder on which the contact spring is secured by a portion of itself in a non-rotatable manner, for securing the contact spring (12), at least one fastening tang (19) protrudes at approximately right angles from the spring holder (11), said fastening tang (19) has a detent head (20), a detent groove (22) and a neck (21), said detent groove (22) is provided as a transition from said detent head (20) to the neck (21), and that the contact spring (12) is embodied with integral circular-annular-segmental detent straps (25), disposed on a circle (26) surrounding said at least one fastening tang (19), which are deployed obliquely out of the plane of the spring and fit behind the detent head (20) in said detent groove (22) on the fastening tang (19) with spring tension.

2. A wiper as defined by claim 1, in which a total of one set of four detent straps (25), each extending over a circumferential angle of 90°, are cut away from the contact spring (12) and are bent out of the spring plane about their outline (26), located on the circle having the largest diameter.

3. A wiper as defined by claim 1, in which the contact spring (12) has a transverse rib (13) with two integral arms (14, 15) pointing obliquely away from said transverse rib, contact prongs (16) being embodied on the free ends of each arm, and that the transverse rib (13) carries the detent straps (25).

4. A wiper as defined by claim 2, in which the contact spring (12) has a transverse rib (13) with two integral arms (14, 15) pointing obliquely away from said transverse rib, contact prongs (16) being embodied on the free ends of each arm, and that the transverse rib (13) carries the detent straps (25).

5. A wiper as defined by claim 1, in which the spring holder (11) has a receiving indentation (18), and the contact spring (12) rests partially, preferably by its transverse rib, substantially form-fittingly, in the receiving indentation (18).

6. A wiper as defined by claim 2, in which the spring holder (11) has a receiving indentation (18), and the contact spring (12) rests partially, preferably by its transverse rib, substantially form-fittingly, in the receiving indentation (18).

7. A wiper as defined by claim 3, in which the spring holder (11) has a receiving indentation (18), and the contact spring (12) rests partially, preferably by its transverse rib, substantially form-fittingly, in the receiving indentation (18).

8. A wiper as defined by claim 4, in which the spring holder (11) has a receiving indentation (18), and the contact spring (12) rests partially, preferably by its transverse rib, substantially form-fittingly, in the receiving indentation (18).

9. A wiper for an electric rotary potentiometer, particularly for use as a rotary position transducer, having a contact spring that has at least one contact prong for establishing electrical contact for a circular resistor path, and having a rotatable spring holder on which the contact spring is secured by a portion of itself in a non-rotatable manner, for securing the contact spring (12), two fastening tangs (19) each with a detent head (20) protrude at approximately right angles from the spring holder (11), and that the contact spring (12) is embodied with integral circular-annular-segmental detent straps (25), disposed on a circle (26) surrounding said at least one fastening tang (19), which are deployed obliquely out of the plane of the spring and fit behind the detent head (20) on the fastening tang (19) with spring tension, said contact spring (12) has a transverse rib (13) with two integral arms (14, 15) pointing obliquely away from said transverse rib, contact prongs (16) being embodied on the free ends of each arm, and that the transverse rib (13) carries two sets of four detent straps (15) each disposed in a circular pattern, and said two fastening tangs (19) correspond to said detent straps and spaced apart by the same spacing are provided on the spring holder (11).

10. A wiper as defined by claim 9 in which a total of one set of four detent straps (25), each extending over a circumferential angle of 90°, are cut away from the contact spring (12) and are bent out of the spring plane about their outline (26), located on a circle having the largest diameter.

11. A wiper as defined by claim 9, in which the spring holder (11) has a receiving indentation (18), and the contact spring (12) rests partially, preferably by its transverse rib, substantially form-fittingly, in the receiving indentation (18).

12. A wiper as defined by claim 10, in which the spring holder (11) has a receiving indentation (18), and the contact spring (12) rests partially, preferably by its transverse rib, substantially form-fittingly, in the receiving indentation (18).

* * * * *